United States Patent [19]

Craver

[11] Patent Number: 4,817,585

[45] Date of Patent: Apr. 4, 1989

[54] FIREBOX DOOR ARRANGEMENT

[75] Inventor: Richard D. Craver, Marshalville, Ohio

[73] Assignee: Orrville Products, Inc., Orrville, Ohio

[21] Appl. No.: 56,046

[22] Filed: Jun. 1, 1987

[51] Int. Cl.[4] ..... F23M 7/02

[52] U.S. Cl. ..... 126/200; 126/190; 126/197; 126/192; 126/194; 126/545; 52/790; 49/398; 312/138 R

[58] Field of Search ..... 126/200, 139, 138, 194, 126/197, 190, 140, 192; 49/398; 52/398, 788, 790, 172; 312/109, 138 R

[56] References Cited

U.S. PATENT DOCUMENTS

| | | | |
|---|---|---|---|
| 2,008,345 | 7/1935 | Blanchford | 126/200 X |
| 2,319,600 | 5/1943 | Heath | 49/398 |
| 2,383,691 | 8/1945 | Smith | 52/398 |
| 2,394,176 | 2/1946 | Hillebrand | 52/790 X |
| 2,719,341 | 10/1955 | Clerk | 52/398 X |
| 2,747,568 | 5/1956 | Dupler | 126/200 X |
| 2,848,762 | 8/1958 | Peterson | 52/398 X |
| 3,079,651 | 3/1963 | Hagmann et al. | 52/790 X |

FOREIGN PATENT DOCUMENTS

| | | | |
|---|---|---|---|
| 2554558 | 5/1985 | France | 126/200 |
| 427992 | 5/1935 | United Kingdom | 126/200 |
| 451702 | 8/1936 | United Kingdom | 126/200 |
| 510834 | 8/1939 | United Kingdom | 126/200 |

*Primary Examiner*—Samuel Scott
*Assistant Examiner*—Carl D. Price
*Attorney, Agent, or Firm*—Body, Vickers & Daniels

[57] ABSTRACT

A semi-frameless door, per se, and in combination with a firebox opening and the like, utilizes a specially configured spacer frame to seal inner and outer glass panes and also, if desired, the firebox opening. Retainer plates affixed only to the outer glass ends and the spacer frame permits the outer pane to be curved with longitudinally extending exposed edges flush with the edge of the spacer frame to create a full glass covering of the opening. The glass size differences and black colored spacer frame create a size illusion and a shadow glow reflection when viewing the fire in the firebox. Inner retainer plates sealing the inner glass to the inside surface of the spacer frame have lip edges which are forced into contact with a fibrous seal disposed in a channel configuration within the opening when the door is latched to insure sealing of the opening should the door hinge ever loosen during extended use.

14 Claims, 5 Drawing Sheets

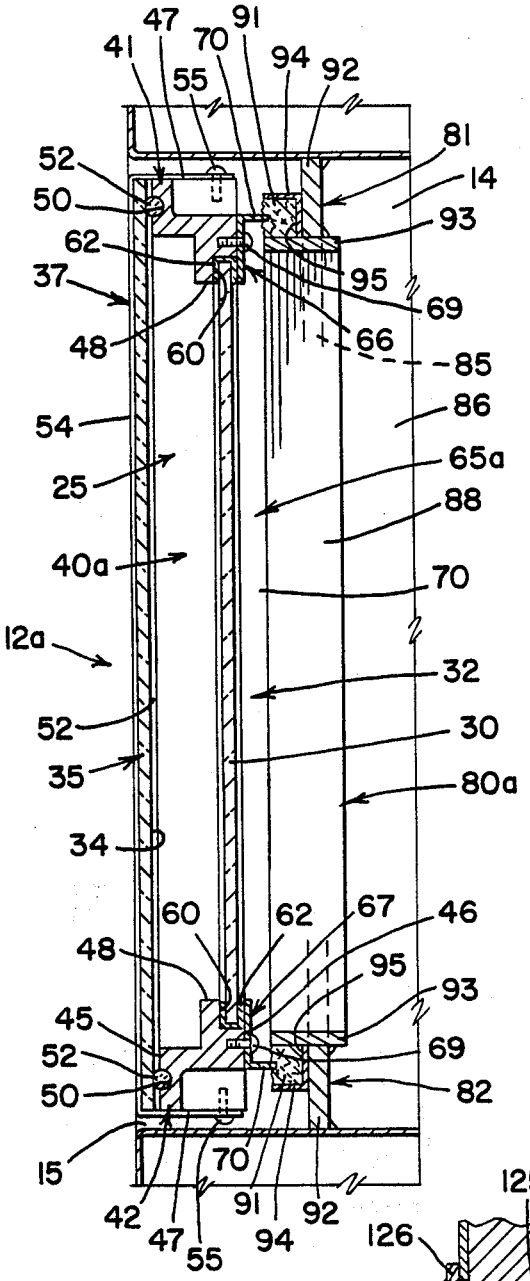
FIG. 3
FIG. 5
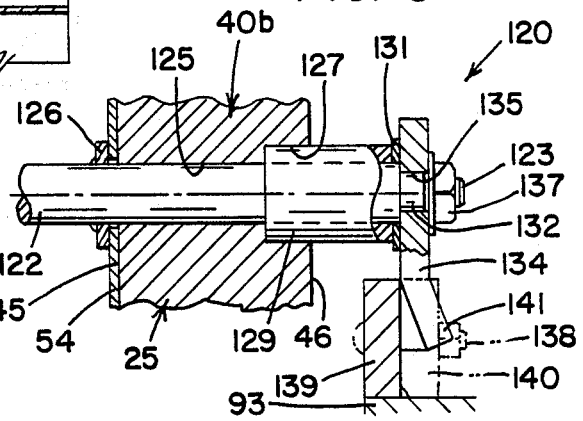

FIREBOX DOOR ARRANGEMENT

BACKGROUND

This invention relates generally to a sealed door construction and more particularly to a two-pane, door construction used to seal a firebox opening.

The invention is particularly applicable to a curved, two-pane, sealed glass door in combination with a sealed firebox opening for fireplace inserts, free-standing woodburning stoves and the like. However, it is to be appreciated that the invention has broader applications and need not be used as a firebox door but could find particular application as an oven door for a cooking stove or range.

All fireplaces and woodburning stoves, whether of a free-standing nature or otherwise, have a firebox for burning wood and other combustibles. All fireboxes have an opening through which wood, coals and the like are loaded. Firebox inserts and free-standing woodburning stoves and the like which have been designed to be highly efficient require that the firebox opening be sealed so that primary and secondary combustion air can be accurately drawn into the firebox to insure thorough combustion. An example of a fireplace insert using a configured firebox to achieve thorough combustion without the necessity of a catalytic converter or afterburner is disclosed in my prior U.S. Pat. No. 4,672,946 which issued June 16, 1987, entitled "Secondary Combustion Device for Woodburning Stove" incorporated herein by reference.

In all such applications, including those utilizing catalytic converters or afterburners, the firebox is hotter than that which occurs in a conventional, open fireplace. Thus, it is important that the sealed door arrangement for such efficient fireplaces be insulated to minimize accidental burning or singing of the user when loading fuel into a hot firebox. At the same time, it is extremely important to fireplace owners that the design of the door be aesthetically pleasing and blend into the surroundings of the room where the fireplace or stove is situated.

Glass pane doors have traditionally been used to close the firebox opening. Typically, such doors are of single pane construction although the glass used has been "smoked" or "blackened" and is tempered or heat resistant. In the "hot" firebox applications described, the glass door construction typically frames the entire pane about its inside and outside peripheral surfaces to secure an adequate seal for the glass. It has been found that when, for aesthetic reasons, a glass curved door is desired for a firebox opening, a sealed door cannot be provided. Typical fireplace openings require a curved surface defined by radius of about 30–36 inches. Tempered, heat-resistant curved glass in such sizes have variations in their radius of curvature of as much as 1½ inches and it has not been possible to construct a frame which seals the inside and outside surfaces of the curved glass about its periphery given such variations. The problem is further aggravated by the natural expansion of the glass as it is exposed to the heat from the firebox. Additionally, the glass must meet certain safety requirements for firebox openings.

Further complicating the door construction is the fact that the door(s) for the firebox opening are large and the weight of the glass panes make the door heavy. This subjects the door hinge and the door opening seal arrangement, which must be adjustable, to a severe operating environment that tends to loosen such adjustments and skew the door(s) within its opening. Heretofore, skewing of the door tended to unseat the seal for the door opening thus leaking air, in an uncontrolled manner into the firebox adversely affecting thorough combustion.

SUMMARY OF THE INVENTION

It is thus a principal object of the invention to provide a two-pane glass fire box door construction which seals the inner and outer panes to not only provide a thermal sealed air space but also to produce such air space in such a manner which permits the door to be constructed out of either flat or curved glass.

This object along with other features of the invention is achieved by a two-pane glass door construction using a spacer frame interposed between the inner glass pane and the outer glass pane. Because the firebox opening is rectangular, the spacer frame is similarly configured into a left and right hand vertically-extending channel portions connected to top and bottom horizontally-extending channel portions. Each channel portion has an inner and an outer face surface and an inner and an outer edge surface. The frame is positioned within the firebox opening so that the outer face surfaces of all channel portions are closely adjacent and almost flush with the firebox opening. The inner face surfaces of all channel portions are indented at areas adjacent the inner edge surfaces of the channel portions. A sealing arrangement is then employed to seal the inner glass pane within the indentation which also seals the firebox opening when the door is in its closed position. The outer glass pane, which is considerably larger than the inner pane, is sealed to the spacer frame by means of a continuous groove formed in the outer face surfaces of the frame into which is placed a fibrous cord seal which protrudes above the groove. Retainer trim plates secured to the left and right hand channel portions firmly force the outer pane into sealing contact with the fibrous cord seal. The arrangement thus provides a thermally sealed air space between the inner and outer panes rendering the door especially suitable for hot firebox applications. When a curved glass door is desired, the outer face surfaces of the spacer frame are curved to resemble the shape of the curved outer pane. Variations in curvature of the outer pane are absorbed by the distance that the fibrous cord seal is compressed when the left and right hand door retainers are secured to the spacer frame. Also, the resilient seal arrangement allows expansion and contraction of the glass as heat is transferred to the glass from the firebox without breakage.

In accordance with another aspect of the invention, the inner pane is heat resistant while the outer pane, preferably, is manufactured from tempered or plain silica sand plate glass instead of a heat resistant glass. Using a plain or plate glass outer pane reduces the cost of the door assembly. Further, a curved plain glass outer pane in combination with a flat heat resistant inner glass pane may be less expensive than an especially configured, curved single pane glass door made from heat resistant glass Additionally, the combination of a plain outer glass pane and a heat resistant inner glass pane provides a door assembly which is better able to meet or exceed safety certification tests when compared to single pane doors since the outer pane acts as a buffer for the inner pane allowing the door disclosed herein to withstand impact and water spray tests, even though the outer pane may be broken while the test is conducted.

In accordance with another aspect of the invention, the outer glass pane is sized so that it's top and bottom horizontal edges are flush with the outer edge surfaces of the top and bottom channel portions of the spacer frame. Because the outer retainer trim plates only cover the left and right hand sides of the outer glass, the semi-frameless arrangement permits the entire width of the outer glass pane to be seen. Ideally, the spacer frame and the outer glass are the same size as or larger than the firebox opening to present an aesthetic configuration which is most appealing to the user of such devices. The aesthetics of the complete configuration are significantly enhanced when the red coals and fiery flames of the fire are partially reflected to the inner glass to produce a "shadow glass" image which is further enhanced if the glass panes are darkened. Since the aesthetics of such configuration have particular importance to the user of such devices, there is particular utility for the optical illusions thus created.

In accordance with yet another aspect of the arrangement, the firebox opening is provided with left and right hand vertically-extending seal members and top and bottom horizontally-extending seal members. Top and bottom seal members are secured at their ends to the left and right hand seal members to provide a rectangular framework within or adjacent the firebox opening for sealing and mounting the door. Each seal member carries an outwardly facing U-shaped channel into which is disposed a fibrous or ceramic seal. The inner glass pane is secured to inner face surfaces of spacer frame by retainer plates which have inwardly extending leg portions extending therefrom. The retainer leg portions depress the seal in the channel to insure sealing of the firebox opening when the door is closed. The position of the channels within or adjacent the firebox opening determines, generally speaking, the size of the inner glass pane. Preferably, the seal members and channels are constructed so that the inner glass pane is at least the size of the firebox opening thus insuring that the outer glass pane is larger than the opening to enhance the overall aesthetic effects achieved by the invention.

In accordance with another aspect of the invention, the mechanism for closing the door includes, one of the vertically extending channel portions of the spacer frame, a top and bottom boss provided with an opening extending through each boss. Top and bottom knuckles, each carrying a pin which is inserted into each one's respective boss' opening, are secured to one leg of a V-shaped hinge. The other leg of the hinge is secured in an adjustable manner to one of the vertically-extending seal members. When the door is latched it is moved inwardly and should the hinge fasteners loosen during use from the weight of the door, or the retainer plates themselves loosen, the firebox opening remains sealed.

It is thus an object of the invention to provide a two-pane door arrangement which employs a thermal air space and which is simple to construct.

It is yet another object of the invention to provide a curved, glass pane door construction for use in sealing a firebox opening and the like.

It is another object of the invention to provide a door construction for use in sealing a firebox opening wherein the outer pane is larger than the firebox opening and the inner pane is at least approximately the size of the firebox opening to enhance the aesthetics of such door It is yet another object of the invention to provide a door construction which seals a firebox opening and the like should the door mountings become loose during use allowing the door to skew in its opening.

It is still another object of the invention to provide a two pane, semi-frameless, spacer frame door construction using a larger outer pane and a smaller inner pane for a firebox opening which provides a glass reflection to enhance viewing the burning of the coals and embers within the firebox.

Still yet another object of the invention is to provide a door combination which is better able to meet and exceed safety specifications for firebox openings.

The invention may take physical form in certain parts and arrangement of parts, a preferred embodiment of which will be described in detail herein and illustrated in the accompanying drawings which forms a part hereof and wherein.

DRAWINGS

FIG. 3 is a cross-sectional view of the door construction taken along line 3—3 of FIG. 2;

FIG. 5 is a further enlarged section view of the latch used in the door construction taken along line 5—5 of FIG. 2.

PREFERRED EMBODIMENT

Figure 1:
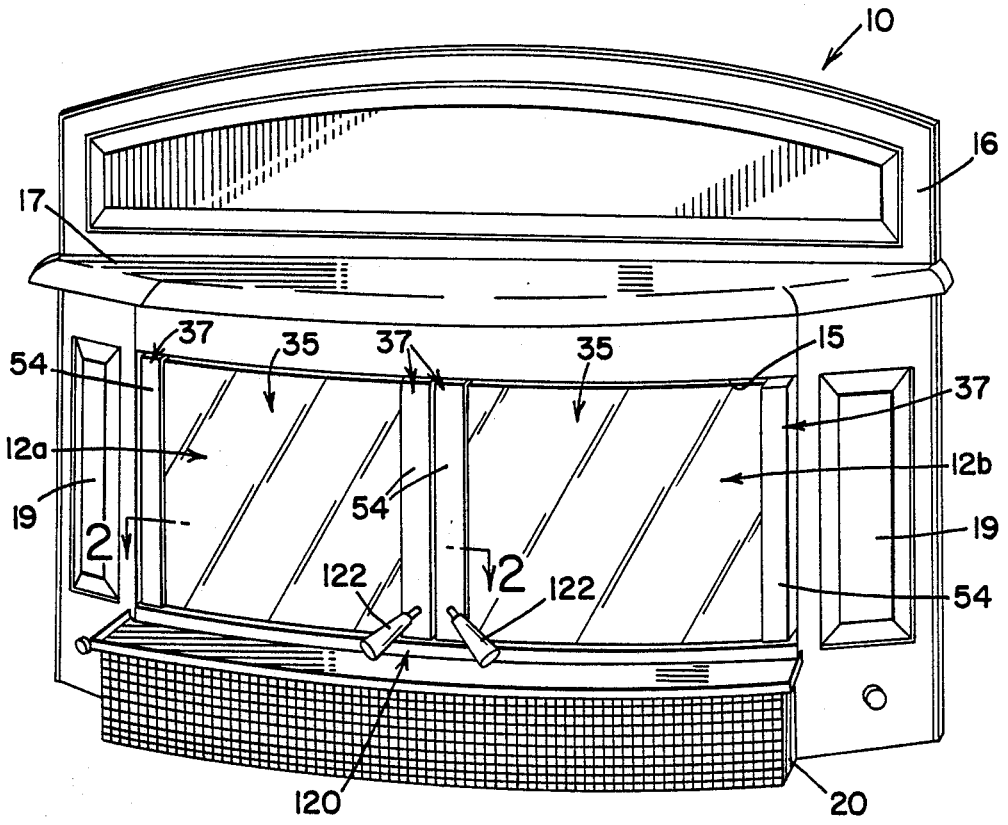
FIG. 1 is a front view, in perspective, of a fireplace insert showing the door arrangement of the invention.

Referring now to the drawings wherein the showings are for the purpose of illustrating a preferred embodiment of the invention and not for the purpose of limiting same, there is shown in FIG. 1 a fireplace insert 10 containing a door 12. Fireplace insert 10 shown in FIG. 1 uses two doors, a left hand door **12*a* and a right hand door 12*b*. Since the left and right hand doors are similar the numeral 12 will be used to designate either door or a single door (if only one is used to close the opening) in these specifications and only one door will be described, it being understood that the second door, if a two door construction is used, is similar to the first door unless otherwise noted. Further, the subscripts "a" and "b" will be used to designate the left hand and right hand when viewing insert 10** from the front.

Figure 2:
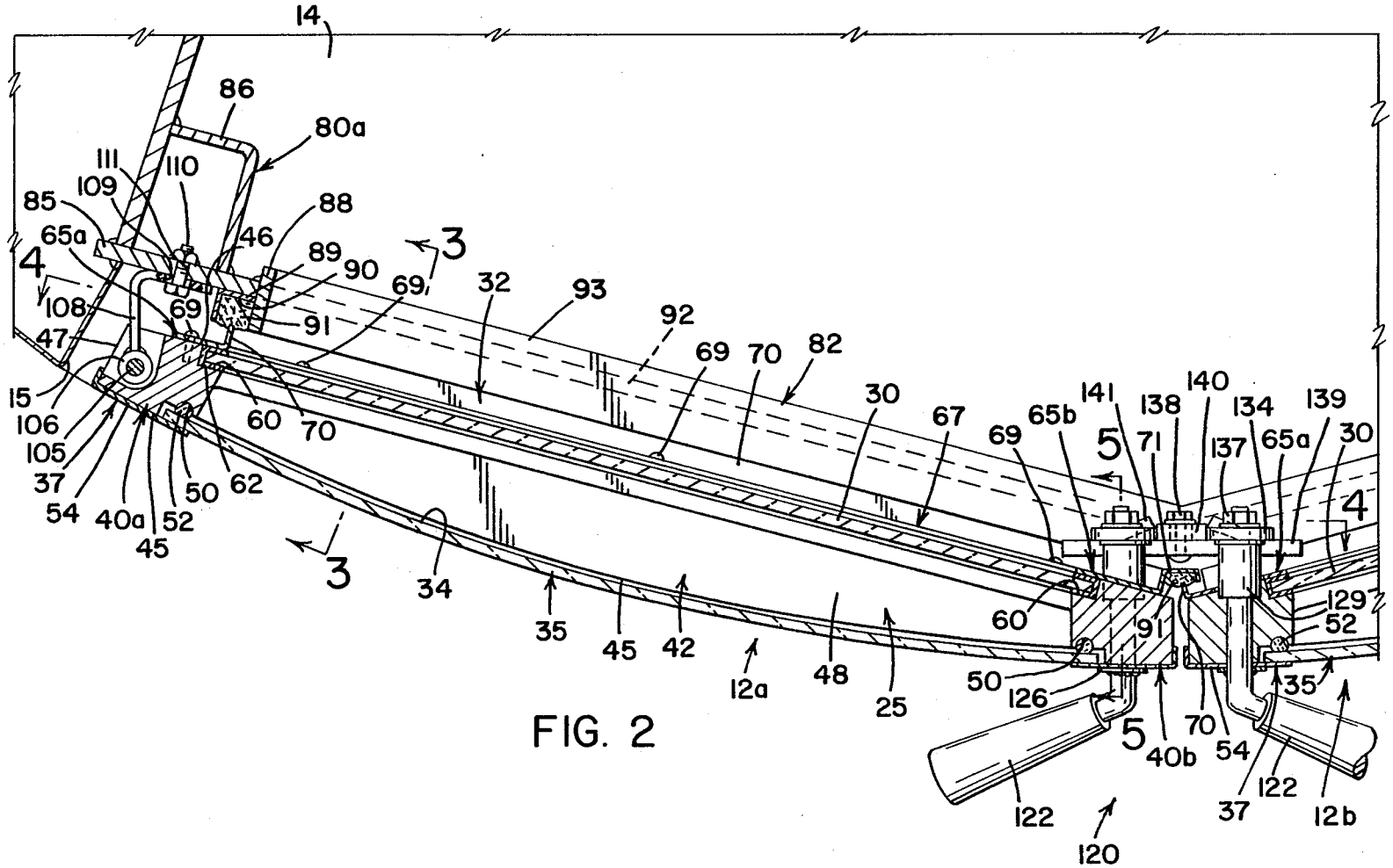
FIG. 2 is an enlarged cross-sectional view of the door construction taken along line 2—2 of FIG. 1.

Insert 10 covers a firebox shown partially in FIGS. 2 and 3 as numeral 14. Firebox 14, per se, does not form part of the invention and is conventional in the art and will not be defined further herein. When used throughout this specification, the term "firebox" and "firebox opening" also means "oven" and "oven range", respectively, or "hearth" and "hearth opening" respectively, it being my intention not to limit the application of door 12 of the subject invention to a firebox opening, per se, unless otherwise stated. An example of a firebox formed by insert 10 is disclosed in my pending application, Ser. No. 859,336, U.S. Pat. No. 4,672,946, filed May 5, 1986 referred to above. Every firebox 14 obviously has an opening through which wood, coals and other combustible products are loaded and for purposes of the specifications, the opening is defined by a plane which is co-planar or coincident with the mantel on side surfaces of insert 10 which are designated by number 15 in the drawings.

Referring again to FIG. 1, insert 10 is a full face insert having a flat upper face portion 16 which is adapted to fit flush against the masonary brick wall usually constructed around the fireplace (not shown). Flat upper face portion 16 terminates at a protruding, generally curved mantel 17 having a center portion under which the doors 12*a* and 12*b* are located and end portions under which extend decorative trademark insert panels 19 which extend to the base of insert 10. Panels 19 may be equipped with grated openings for purposes of admitting secondary combustion air into the firebox. Below the doors 12*a*, 12*b* and at the bottom of insert 10 is a protruding blower housing 20 which houses a blower fan (not shown) for purposes of exhausting heated air into the room and which also provides for the ingress of primary combustion air into the firebox.

Figure 6:
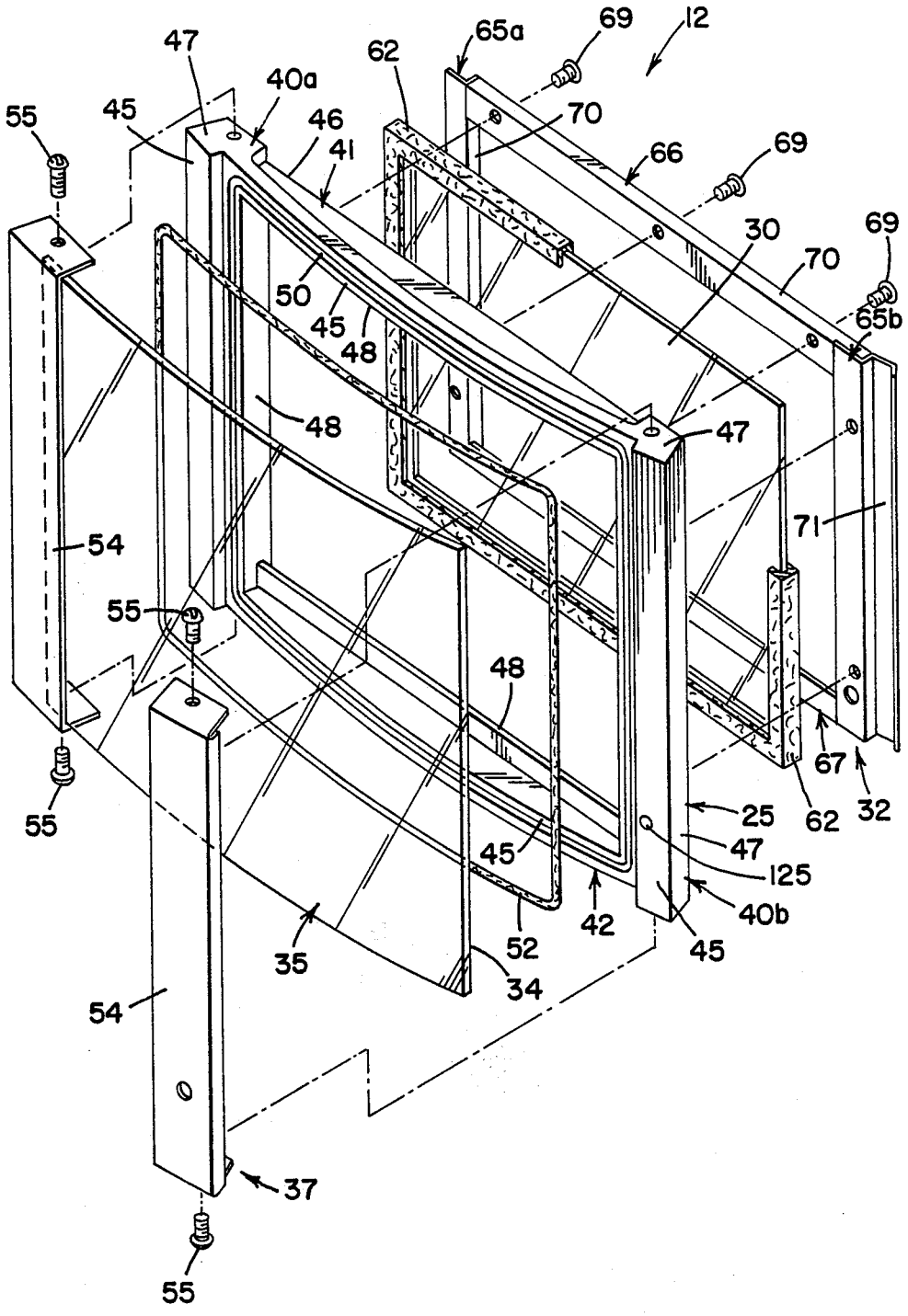
FIG. 6 is an exploded perspective view showing the construction of the door, per se.

Referring now to FIG. 6 there is shown the principal components of door 12. Such components include a spacer frame 25 which preferably is a steel or iron casting. An inner glass pane 30 is secured by sealing means indicated generally at 32 to the inner surface of spacer frame 25. There is also provided an outer glass pane 35 which is secured by outer sealing means designated as 37 to the outside surface of spacer frame 25. Both inner and outer panes 30, 35 are shown as being generally rectangular in peripheral configuration although, in fact, their peripheral shape will be determined by the shape of firebox opening 15. As noted above, inner pane 30 is a heat resistant glass while outer pane 35 is a conventional tempered or silica sand plate glass, i.e. a "plain" glass. Outer pane 35 is curved in a concave direction when viewed from inside firebox 14. The radius of curvature of outer glass pane 35 is defined by an arc struck on the center line of firebox 14 with a radius of approximately 30 to 36 inches although the radius considering the possible use of multiple curved panes within the framework of one door could be as small as 6 inches. The smaller the radius, the more critical are tolerance deviations to the fit of the glass. It should also be noted that outer glass pane 35 is significantly larger than inner glass pane 30 and that the horizontal edges of outer pane 35 are approximately flush with the outside edges of spacer frame 35.

Referring now to FIGS. 2, 3 and 6, spacer frame 25 comprises vertically-extending left and right hand channel portions 40*a*, 40*b* respectively, a top horizontally-extending portion 41 and a bottom horizontally-extending portion 42. Horizontally-extending portions 41, 42 connected at their ends to vertically-extending portions 40*a*, 40*b* to form a contiguous rectangular frame. Each channel portion 40*a*, 40*b*, 41, 42 in turn has an outer face surface 45, an inner face surface 46, an outer edge surface 47 and an inner edge surface 48. So as to maintain proper orientation of surfaces 45, 46, 47 and 48 relating to channel portions. Throughout the specifications, the very top most and bottom most surfaces of left and right channel portions 40*a*, 40*b* are in fact the outer edge surfaces 47 of top and bottom channel portions 41, 42 respectively.

Each channel portion 40*a*, 40*b*, 41, 42 has a continuous groove 50 formed in its outer face surface 45 approximately midway between the outer and inner edge surfaces 47, 48 with the groove being thus shaped as a continuous rectangle. Additionally, the outer face surfaces 45 of each channel portion 40*a*, 40*b*, 41 and 42 are curved to approximately the same radius of curvature as that of outer glass pane 35. If outer glass pane 35 were flat, then the front face surfaces 45 would also be flat. Disposed within groove 50 is a ceramic or fibrous cord seal 52, such as Fibrefax. Cord seal 52 extends or protrudes beyond groove 50. As best shown in FIG. 6, the inner surface 34 of outer glass pane 35 compresses seal 52 within groove 50 by trim retainer plates 54 which cover the outer face surfaces 45 of left and right hand portions 40*a*, 40*b* of spacer frame 25 and are secured by fasteners 55 to outer edge surface 47 and inner edge surface 48 of right and left hand channel portions 40*a*, 40*b*. Trim retainer plates 54 are preferably formed from brass and may be chrome-plated or nickel plated to enhance the aesthetics of door 12. Trim retainer plates 54 are so sized with respect to the position of fasteners 55 relative to the outer edge surfaces 47 of top and bottom channel portions 41, 42 that inner surface 34 of outer glass 35 contacts front face surfaces 45. Seal 52 protrudes a sufficient distance to compensate for the normal tolerances of about 1 to 2 inches in the curvature of outer glass pane 35 and also for any expansion or contraction of outer glass 35 from the heat emitted from firebox 14. Further, as best seen in FIG. 3, the horizontally-extending edge surfaces of outer glass pane 35 are flush with outer edge surfaces 47 of top and bottom horizontally-extending channel portions 41, 42. Outer glass pane 35 may be black or blackened about its area adjacent outer face surfaces 45 of channel portions 40*a*, 40*b*, 41 and 42 and the outer face surfaces 45 of all channel portions are likewise painted black so that seal 52 is not visible. As thus described, since the horizontally-extending edge surfaces of outer glass pane 35 are exposed but sealed, the door construction, illustrated, at least for outer glass pane 35, is semi-frameless. In practice, pane 35 is usually clear.

Inner face surface 46 of each channel portion 40*a*, 40*b*, 41, 42 has an indentation 60 formed therein which extends from the inner edge surface 48 of each channel portion 40*a*, 40*b*, 41, 42 to a point approximately midway the length of-each inner face surface 46 so that a rectangular indentation slightly larger than inner glass pane 30 is formed on the inner surface of spacer frame 25. As best shown in FIG. 6, a flexible, fibrous or ceramic seal 62 made out of conventional material such as Fibrefax and is fitted in the form of a U over the edges of inner glass pane 30 and inner pane 30 with U-shaped seal 62 is placed into indentations 60. Fibrous U-shaped seal 62 is actually formed or weaved as a mat with the leg portions double weaved or twice the thickness as the center portion. One of the legs of U-shaped seal 62 is seated against indentation 60 while the other leg of seal 62 is seated against generally flat retainer plates. The inner retainer plates comprise vertically-extending left and right hand inner retainer plates 65*a*, 65*b* respectively and horizontally-extending top and bottom inner retainer plates 66, 67 respectively which abut each other to form a rectangular inner retainer frame. Each inner retainer plate 65*a*, 65*b*, 66 and 67 is secured to its respective inner face surface 46 of spacer frame 25 by means of threaded fasteners 69. Each inner retainer plate 65*a*, 65*b*, 66, 67 has a protruding lip or edge portion 70 which extends away from spacer frame 25 and inwardly into firebox opening 14. When a two door construction is used as illustrated in the drawings, one of the vertically-extending retainer plates 65, which in the drawings is shown as right hand retainer 65*b* for left hand door 12*a* has an outwardly facing channel shaped retainer portion 71 instead of an inwardly facing lip edge portion 70 which is adapted to receive lip edge portion 70 of left hand vertically-extending inner retainer 65*a* of right hand door 12*b*. When only one door, 12, is used to seal firebox opening 14, all retainers will seal firebox opening 14 by means of lip edge portion 70. With the inner and outer glass panes 30, 35 sealed in the manner described to spacer frame 25, a sealed air space between inner and outer glass panes 30, 35 is established which functions in the normal, conventional insulating manner.

Referring now to FIGS. 2 and 3, a framework within firebox opening 15 is established to mount and seal door 12. The framework comprises vertically-extending left and right hand seal members 80*a*, 80*b* (right hand member not shown) and a top horizontally-extending seal member 81 and a bottom horizontally-extending seal member 82. Top and bottom horizontally-extending seal members 81, 82 are connected at their end portions to vertically-extending seal members 80*a*, 80*b* to define a generally rectangular shaped framework. Left hand vertically-extending seal member 80*a* is a fabricated assembly shown in FIG. 2 to comprise a flat vertically-extending plate 85 buttressed by an angle 86 so that it is secured in a fixed position relative to firebox opening 14. At the inward end of vertically-extending plate 85, there is welded an outwardly extending flat plate 88 and on the outward face of vertically-extending plate 85 there is welded an angle 89 so that angle 89 and flat plate 88 together form a U-shaped channel 90 into which a ceramic fibrous sealing material 91 which is conventionally known in the art and available under the tradename FIBRE FAX and other names is applied. Fibrous sealing material 91 is packed in place within U-shaped channel 90 and held in place by friction. Similarly, top and bottom seal members 81, 82 each comprise a horizontally-extending plate 92 secured to firebox 14 and abutted by the inwardly facing edge surfaces with a flat plate 93 which is secured at their ends to flat plate 88. An angle 94 is situated on horizontally-extending plate 92 and in conjunction with flat plate 93 defines a U-shaped outwardly extending channel 95 into which is disposed fibrous sealing material 91. As shown, when door 12 is closed, lip edge portion 70 of each inner retainer plate 65*a*, 65*b*, 66, 67 push against fibrous sealing material 91 in U-shaped channels 90, 95 to provide a seal for firebox opening 15. In the two door arrangement disclosed, fibrous sealing material 91 is disposed within channel shaped portion 71 of right hand retainer plate 65*b* of left hand door 12*a* which is sealed by lip edge portion 70 of left hand inner retainer plate 65*a* of right hand door 12*b*. The arrangement disclosed for sealing firebox opening 15, i.e. sealing members 80*a*, retainer plates 65*a*, 65*b*, 66, 67 has been used in my prior art fireplace inserts and has proven to be an effective, long-lasting seal. It should be noted, that the positioning of seal members 80*a*, 80*b*, 81 and 82 with respect to firebox opening 15 determines the position and size of outer glass pane 35 and inner glass pane 30 with respect to firebox opening 15. Ideally, the positioning is such that outer glass pane 35 is flush with or indented inwardly with respect to the mantle of the fireplace insert 10. Seal members 80*a*, 80*b*, 81, 82 would be constructed relative to fireplace insert 10 to form a framework slightly larger than or equal to the firebox opening. Thus inner glass pane 30 would be at least the size of the opening and outer glass pane 35 would be greater than the firebox opening. Obvious modifications are apparent. Seal members 80*a*, 80*b*, 81, 82 could be positioned further within the firebox opening 15 which would thus result in inner glass pane 30 being slightly smaller than firebox opening 15.

Figure 4:
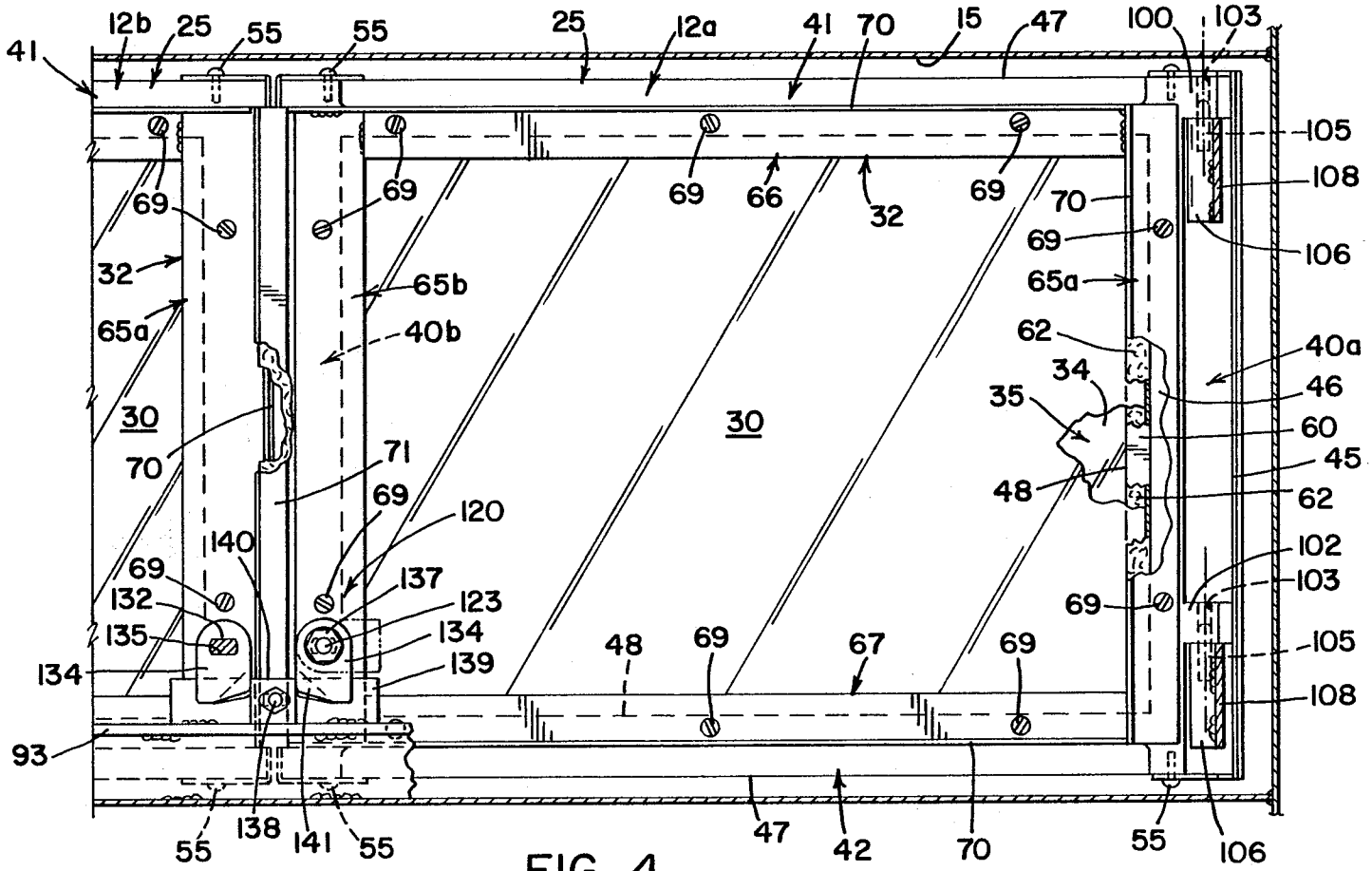
FIG. 4 is a rear, sectional view of the inwardly facing side of the door taken along line 4—4 of FIG. 2.

FIGS. 2 and 4 illustrate the mechanism for mounting door 12 to vertically-extending seal member 80. Outer edge surface 47 of one of the vertically-extending channel portions 40*a*, 40*b* of spacer frame 25 has a top boss 100 and a bottom boss 102 extending therefrom. Top boss 100 extends downwardly from a plane co-planar with outer edge surface 47 of top channel portion 41. Bottom boss 102 extends upwardly from a point removed from inner edge surface 48 of bottom channel portion 42. Both top and bottom boss 100, 102 have an opening 103 extending therethrough. Openings 103 are adapted to receive mounting pins 105 secured to knuckles 10 to provide a conventional "hidden" hinge. Knuckles 106 are in turn welded to one of the legs of a V-shaped hinge member 108 the other leg of hinge member 108 has a plurality of slots spaced along its length. One of such slots is shown at 109 in FIG. 2. Holes 111, threaded or otherwise, are similarly positioned in flat plate 85 and fasteners 110 extend through slots 109 and into holes 111 to hinge door 12 in an adjustable manner to vertically-extending seal member 80.

Referring now to FIGS. 2, 4 and 5 there is shown a latch mechanism 120 similar to that which I have used in the past on my double door, fireplace insert designs. A handle 122 having a threaded end 123 is rotatable within a cylindrical opening 125 in one of the vertically-extending channel portions 40 of spacer frame 25. A washer 126 secured to handle 122 functions as a stop and determines how far handle 122 can extend through cylindrical opening 125 which is stepped as at 127. A sleeve spacer 129 fits into stepped portion of opening 127 and at its opposite end carries a washer 131. As best shown in FIG. 4, especially configured 132 of handle 122 receives a locking member 134 which has a similarly configured opening 135 to permit rotation of locking member 134 as handle 122 is rotated. Locking member 134 is thicker than the especially configured end 132 so that when a conventional hex-head nut 137 is threaded onto end 123 handle 122 is secured within spacer frame 25 between washer 126 and spacer sleeve 129. A locking plate 139 is secured by means of welding to flat plate 93. When the doors are closed, rotation of handle 122 will cause locking member 134 to come into face contact with locking plate 139. To insure a smooth cam action contact between locking member 134 and locking plate 139, the leading bottom edge of locking member 134 is bent to form a tab as at 141. A block 140 is adjustably secured to locking plate 139 by means of a slotted fastener arrangement 138. Block 140 stops the rotation of locking members 134 as handle 122 is rotated. The sizing of the various latch parts and the angle of provides a secure latch arrangement which forces door 12 into firebox opening 15 to secure sealing of the opening by retainer lip portions 70 bearing against fibrous seal material 91 contained within channels 90, 95. Importantly, because of the weight and length of door 12, should fasteners 110 for hinge 108 loosen or should door 12 skew with respect thereto or should, for some reason, fasteners 69 holding inner retainer plate 65, 66, 67 loosen, sealing of firebox opening 15 will not be seriously impaired.

The invention has been described with reference to a two door 12*a*, 12*b* construction for a full face fireplace insert 10. It should be clear that the invention can function as a single door arrangement and a single door arrangement is particularly desirable for use in a free-standing woodburning stove and the like. In a single door arrangement there would not be any channel shaped portion 71 in any vertically-extending inner retainer plate 65*a*, 65*b*. Lip edge portions 70 of inner retainer 65, 66 and 67 would form a rectangularly shaped protrusion which would be received in horizontal and vertical channels 90, 95 which would contain fibrous sealing material 91. Handle 122 could be replaced by a latch mounted on outer face surface 45 of one of the vertically-extending channel portions 40*a*, 40*b* of spacer frame 25. This latch would lock against a pin inserted in one of the vertically-extending seal support members 80*a*, 80*b* in a conventionally known manner. The remaining portions of the single door construction would be identical to that disclosed herein for the two door construction.

Also, while it is particularly important that the door construction illustrated finds particular utilization in sealing a curved glass pane 35, the semi-frameless door construction illustrated will function if the outer glass pane 35 were flat and not curved. In such instance, the outer face surfaces 45 of channel portions 40, 41, 42 of spacer frame 25 would simply be parallel with inner face surfaces 46 of spacer frame 25. The shadow glass image and full pane viewing effect present in a curved pane door would also be present in a flat pane door.

Additionally, while the particular design of trim plates 54 present a front opening which has been defined as semi-frameless, it should be obvious that trim plates need not extend the entire length of outer glass pane 35. Corner tabs could be alternatively provided and yet provide sufficient clamping pressure to compress cord seal 52. Alternatively, a retainer could be applied or glued to the inside surface of outer glass pane 35 and that retainer secured to the spacer frame to compress cord seal 52. In this modification, the door would be "frameless".

Further, doors 12 could also be applied to a conventional fireplace without the necessity of any insert. A vertically-extending plate 85, hinge 108 and latch mechanism 120 would only need be supplied for either a single door or double door arrangement. Sealing firebox opening 15 would not be a necessary requirement for such an installation. Also, while the arrangement has been described with reference to a firebox, it is specifically contemplated that the door construction illustrated could find specific application and use as an oven door for residential gas and electric ranges and the like.

It is my intention to include all such modifications within the scope of my invention.

It is thus an essential aspect of the invention to provide a two glass pane door construction for use with firebox openings and the like.

Having thus defined my invention, I claim:

1. A door in combination with an opening for a firebox and the like comprising:

an outer glass pane having a periphery defined by vertically-extending right hand and left hand edge surfaces contiguous with longitudinally extending top and bottom edge surface;

a spacer frame having vertically-extending right hand and left hand channel portions and longitudinally extending top and bottom channel portions, said top and bottom channel portions connected at their ends to the ends of said right and left hand portions to define a contiguous, open spacer frame, each channel portion of said spacer frame having an inner face surface adapted to face said opening, an outer face surface removed from said opening formed by said spacer frame and an outer edge surface defining the exterior surface of said spacer frame;

outer sealing means for thermally sealing said outer glass pane to said outer face surfaces with said top and bottom edge surfaces of said outer glass pane generally flush and aligned with said outer edge surfaces of said top and bottom channel portions of said spacer frame, said outer sealing means including outer retainer means overlying only at least portions of said right hand and said left hand portions of said spacer frame to effect said thermal seal while exposing a substantial portion of said top and bottom edge surfaces of said outer glass pane whereby said top and bottom edge surfaces of said outer glass pane defines the top and bottom of said door;

hinge means for adjustably securing said door to said opening;

latch means for locking said door in a closed position in said opening.

2. The door combination of claim 1 wherein said outer glass pane is curved;

said door includes an inner glass pane; and inner sealing means for thermally sealing said inner glass pane to said inner face surfaces of said spacer frame to define an airtight space between said glass panes while also sealing said door to said opening.

3. A two pane door for closing a firebox opening and the like comprising:

an inner, heat resistant glass pane;

an outer glass pane having a periphery defined by vertically-extending right hand and left hand edge surfaces contiguous with longitudinally-extending top and bottom edge surfaces;

a spacer frame having vertically-extending right hand and left hand channel portions and longitudinally extending top and bottom channel portions, said top and bottom channel portions connected at their ends to the ends of said right and left hand portions to define a contiguous, open spacer framework, each channel portion of said spacer frame having an inner face surface adapted to face said opening, and an outer face surface removed from said opening, and an inner edge surface adjacent the interior opening formed by said spacer frame and an outer edge surface defining the exterior surface of said spacer frame;

inner sealing means for thermally sealing said inner glass pane to said inner face surfaces of said spacer frame;

outer sealing means for thermally sealing said outer glass pane to said outer frame face surfaces with said top and bottom edge surfaces of said outer pane generally flush and aligned with said outer edge surfaces of said top and bottom channel portions of said spacer frame;

said inner glass pane, said outer glass pane and said spacer frame having an outer edge peripheral configuration which is generally rectangular irrespective of the shape of said glass panes;

said outer sealing means further includes each outer face surface having a contiguous groove formed therein, said groove in each channel portion in communication with said groove in an adjacent channel portion, a fibrous sealing cord disposed within said groove extending above said face surface a predetermined distance, and said outer retainer means positioned only over said right and left hand channel portions and biasing said outer glass pane into continuous sealing contact with said fibrous sealing cord;

said outer retainer means further including right and left hand decorative retainer strips extending a distance approximately equal that of said right and left hand channel portions of said spacer frame, each decorative retainer strip having a top and bottom bend tab portion at their ends and fastening means for securing said top and bottom tab portions to said outer edge surfaces of said top and bottom channel portions, respectively.

4. A two pane door for closing a firebox opening and the like comprising:

an outer glass pane having a periphery defined by vertically-extending right hand and left hand edge surfaces contiguous with longitudinally extending top and bottom edge surfaces;

a spacer frame having vertically-extending right hand and left hand channel portions and longitudinally-extending top and bottom channel portions, said top and bottom channel portions connected at their ends to the ends of said right and left hand portions to define a contiguous, open spacer frame, each channel portion of said spacer frame having an inner face surface adapted to face said firebox opening, an outer face surface removed from said opening, an inner edge surface defining the interior surface of said spacer frame and an outer edge surface defining the exterior surface of said spacer frame;

inner sealing means for thermally sealing said inner glass pane to said inner face surfaces of said spacer frame;

outer sealing means for thermally sealing said outer glass pane to said outer face surfaces with said top and bottom edge surfaces of said outer pane generally flush and aligned with said outer edge surfaces of said top and bottom channel portions of said spacer frame, said outer sealing means including outer retainer means overlying only at least portions of said right hand and said left hand portions of said spacer frame to effect said thermal seal while exposing a substantial portion of said top and bottom edge surfaces of said outer glass pane whereby said top and bottom edge surfaces of said outer glass pane defines the top and bottom of said door;

said inner glass pane, said outer glass pane and said spacer frame having an outer edge peripheral configuration which is generally rectangular irrespective of the shape of said glass panes;

said outer sealing means further includes each outer face surface of each channel portion having a contiguous groove formed therein, said groove in each channel portion in communication with said groove in an adjacent channel portion, a fibrous sealing cord disposed within said groove extending above said face surfaces a predetermined distance, and said outer retainer means biasing said outer glass pane into contiguous sealing contact with said fibrous sealing cord;

said inner glass sealing means includes each inner face surface of each channel portion having an indentation formed therein, each indentation extending from said inner edge surface of each channel portion to a position spaced from said outer edge surface of each channel portion, each indentation in communication and aligned with adjacent indentation; a U-shaped fibrous seal positioned about the edge of said inner glass pane, one leg of said U-shaped seal to thermally seal said inner pane to said spacer frame thereby defining a sealed air space within said spacer frame between said inner glass pane and said outer glass pane, said inner retainer means includes a rigid right hand and left hand inner retainer strip and a rigid tip and bottom inner retainer strip, said right and left hand inner retainer strips abutting at their ends with the ends of said top and bottom inner retainer strips, each inner retainer strip contacting said other leg of said U-shaped seal; fastening means for securing each inner retainer strip to its respective inner face surface whereby a thermal seal is established by said U-shaped seal being compressed between said indentation and said inner retainers, each inner retainer strip including means formed and extending therefrom to seal said door to said firebox opening when said door is closed; and hinge and latch means affixed to said door whereby said door can be mounted in said opening in a movable and lockable manner.

5. An insulated sealed door in combination with a generally rectangular firebox opening for a fireplace insert, free-standing woodburning stove and the like comprising:

generally vertically-extending, left and right hand seal support members positioned inside of said opening at each end thereof and generally parallel to one another, generally horizontally-extending, top and bottom seal support members generally parallel to another and secured to the top and bottom of said opening, said top and bottom seal support member secured at their ends to the ends of said left and right hand seal support members; a door seal disposed within each seal support member;

generally rectangular inner and outer, heat resistant glass panes, said outer glass pane larger than said inner glass pane;

a generally rectangular spacer frame positioned between said inner and outer glass panes, said frame defined by a left hand a right hand vertically-extending channel portion, and a top and a bottom horizontally-extending channel portion, said top and bottom channel portions connected at their ends to the ends of said left hand and said right hand channel portion having an inner face surface adjacent said opening, an outer face surface removed from said opening, an inner edge surface defining the interior of said spacer frame and an outer edge surface defining the exterior of said spacer frame;

inner pane sealing means for sealing said inner glass pane to said inner face surfaces and also sealing said door to said seal support members when said door is closed, said inner glass pane positioned to be adjacent said inner edge surfaces of said top and bottom horizontal channel portions and removed from said outer edge surfaces of said top and bottom horizontal channel portions;

outer pane sealing means for sealing said outer glass pane to said outer face surfaces, said outer glass pane positioned closely adjacent said outer edge surfaces of said top and bottom channel portions and removed from said inner edge surfaces of said top and bottom channel portions;

hinge means secured to one of said vertically-extending channel portions and one of said vertically-extending seal support members to permit said frame to swing away from said opening in an open position and into said opening in a closed position, said outer glass pane being approximately flush with said opening in said closed position;

latch means for securing said door when said door is closed and insuring the sealing of said door to said opening by said inner pane sealing means.

6. The door-opening combination of claim 5 wherein said outer pane sealing means further includes, said outer face surfaces of said channel portions having a groove formed therein, a cord seal disposed within and partially extending out of said groove, said outer glass pane in contact with said cord seal, a left hand and a right hand vertically-extending outer retainer trim strip in contact with said outer glass pane and secured, respectively, to said left and right hand channel portions of said spacer frame whereby the horizontally-extending edge surfaces of said outer glass pane are exposed while said outer pane remains in sealing contact with said cord seal.

7. The door-opening combination of claim 6 wherein said outer face surfaces of said spacer frame are uniformly curved in a concave direction with respect to said opening and said outer glass pane is similarly curved.

8. The door-opening combination of claim 6 wherein the horizontally extending edge surfaces of said outer glass pane are approximately flush with said outer edge surfaces of said top and bottom channel portions.

9. The door-opening combination of claim 5 wherein said inner pane sealing means includes an indentation formed in each channel portion's inner face surface adjacent said inner edge surface thereof, a U-shaped seal fitted about the edge of said inner glass pane, an inner pane retainer contacting one of the legs of said U-shaped seal and secured to said inner face surface whereby said inner glass pane is sealed to said spacer frame.

10. The door-opening combination of claim 9 wherein, said inner pane retainer includes a right and a left hand and a top and a bottom inner retainer strip secured, respectively, to said inner right and left hand, top and bottom face surfaces, each retainer strip including a sealing leg extending towards said opening and away from said inner pane; a channel formed in said right and left hand and top and bottom seal support members, a fibrous seal disposed within each channel, said sealing leg of said right hand, left hand, top and bottom retainer strips adapted to contact, respectively, said fibrous seal in said channels of said right hand, left hand, top and bottom support members when said door is in the closed position.

11. The door-opening combination of claim 5 wherein said outer edge surface of one of said vertically-extending channel portions has a top and a bottom boss formed therein, each boss having an opening extending therethrough, said top boss adjacent said outer face surface of said top channel portion, said bottom boss adjacent said outer face surface of said bottom channel portion; a generally V-shaped door hinge support member having one of its legs secured to one of said vertically-extending seal support members; a top and bottom knuckle secured to the other leg of said door hinge, each knuckle having a pin secured to one end thereof whereby each pin fits into said opening in an associated boss to affix said door to said opening; and slotted means associated with said leg of said door hinge support member affixed to said vertically-extending seal support member for adjusting said door's position relative to said opening.

12. The door-opening combination of claim 11 wherein said latch means includes one of said vertically-extending channel portions of said spacer frame having an opening extending therethrough; a handle having a shaft rotatable within said channel portion's opening; a locking member secured to said shaft and adjacent said inner edge surface of said vertically-extending channel portion having said opening, said locking member having a flat locking surface and bent guide surface extending therefrom; a generally flat, vertically-extending locking post within said opening adapted to contact said flat locking surface when said handle is rotated whereby said door is sealed to said opening even if relative movement of said door hinge support member and said inner pane sealing means should occur.

13. The door-opening combination of claim 5 further including a second door, said left hand channel portion of said spacer frame of said first door secured by said hinge means to said left hand vertically-extending support member, second hinge means for securing said right hand channel portion of said spacer frame of said second door to said right hand vertically-extending seal support member; a first vertically-extending outer trim retainer having an outwardly opening channel, said first trim retainer secured to said inner face surface of said right hand channel portion of said first frame; a fibrous seal disposed within said channel, a second vertically-extending outer trim retainer member having an inwardly extending lip, said second retainer secured to said inner face surface of said left hand channel portion of said second spacer frame, said lip adapted to seat within said channel and contact said fibrous seal to seal said opening when said first and second doors are in a closed position.

14. The door-opening combination of claim 13 wherein said outer face surfaces of said first and second spacer frames are uniformly curved in a concave direction with respect to said opening and each outer glass pane of said first and second door is similarly curved.

* * * * *

UNITED STATES PATENT AND TRADEMARK OFFICE

CERTIFICATE OF CORRECTION

PATENT NO. : 4,817,585

DATED : April 4, 1989

INVENTOR(S) : Richard D. Craver

It is certified that error appears in the above-identified patent and that said Letters Patent is hereby corrected as shown below:

Column 9, line 61, after "longitudinally" insert a hyphen(-). Column 10, line 3, after "opening" insert --- , an inner edge surface adjacent the interior opening ---. Column 11, line 13, "bend" should read --- bent ---; line 65, "contiguous" should read --- continuous ---. Column 12, line 13, "tip" should read --- top ---; line 50, after "hand" insert --- and ---; (1st occurr line 54, after "channel" insert ---portions to define said rectangular frame, each channel ---.

Signed and Sealed this

Tenth Day of July, 1990

*Attest:*

HARRY F. MANBECK, JR.

*Attesting Officer*

*Commissioner of Patents and Trademarks*